US005943902A

United States Patent [19]

Ishihara

[11] Patent Number: 5,943,902

[45] Date of Patent: Aug. 31, 1999

[54] SHEET METAL DRAWING EQUIPMENT

[76] Inventor: Kosei Ishihara, No. 2221-10, Nekoyamachi, Takasaki-shi, Gunma-ken, Japan

[21] Appl. No.: 08/779,207

[22] Filed: Jan. 6, 1997

[30] Foreign Application Priority Data

Jan. 15, 1996 [JP] Japan ..... 8-023054

[51] Int. Cl.[6] ..... B21J 9/18

[52] U.S. Cl. ..... 72/451; 72/705

[58] Field of Search ..... 72/389, 390, 391, 72/447, 451, 705, 31.01, 31.02, 16.3, 17.3, 19.6

[56] References Cited

U.S. PATENT DOCUMENTS

| | | | |
|---|---|---|---|
| 2,863,489 | 12/1958 | Priest | 153/38 |
| 3,545,250 | 12/1970 | Jones | 72/705 |
| 3,712,106 | 1/1973 | Holsapple et al. | 72/705 |
| 4,026,139 | 5/1977 | Glaser | 72/705 |
| 4,252,008 | 2/1981 | Dibbens | 72/705 |
| 4,914,942 | 4/1990 | Ishihara | 72/463 |
| 4,930,335 | 6/1990 | Ishihara | 72/451 |
| 5,333,486 | 8/1994 | Ishishara | 72/391.2 |
| 5,445,000 | 8/1995 | Brown | 72/31.01 |
| 5,473,928 | 12/1995 | Teitzel | 72/705 |

FOREIGN PATENT DOCUMENTS

| | | | |
|---|---|---|---|
| 9315560 | 2/1994 | Germany . | |
| 58-14020 | 9/1983 | Japan | 72/31.02 |
| 62-27290 | 7/1987 | Japan . | |
| 1754274 | 8/1992 | U.S.S.R. | 72/31.01 |

*Primary Examiner*—Joseph J. Hail, III
*Assistant Examiner*—Ed Tolan
*Attorney, Agent, or Firm*—Steinberg & Raskin, P.C.

[57] ABSTRACT

A sheet metal drawing equipment capable of providing a both thereof with strength sufficient to minimize deformation thereof during operation, to thereby increase durability thereof and stabilizing a gravity thereof to facilitate operation. The equipment includes a pair of legs each provided with surface contact sections adapted to be abuttedly contacted with a surface of a sheet metal, rails for slidably supporting the legs thereon, a slide frame member slidably supported on the rails, a pair of operation arms each pivotally supported at one end thereof on the slide frame members, a central shaft arranged so as to extend in a direction perpendicular to a longitudinal direction of the rails, inserted via the slide frame member and moved by operation of the operation arms, and connection arms each arranged in correspondence to each of the operation arms and pivotally connected at one end thereof to corresponding one of the operation arms and at the other end thereof to the central shaft.

20 Claims, 21 Drawing Sheets

SHEET METAL DRAWING EQUIPMENT

BACKGROUND OF THE INVENTION

This invention relates to a sheet metal drawing equipment, and more particularly to an improvement in a sheet metal drawing equipment which is adapted to permit a recess of a sheet metal which is to be drawn to be suitably drawn through washers welded to the recess.

A conventional sheet metal drawing equipment of such a type is disclosed in Japanese Utility Model Publication No. 27290/1987 (62-27290) and constructed in such a manner as shown in FIGS. 17 to 20, wherein drawing of a recess 250 of a sheet metal is carried out through a fitment 260 welded to a surface of the recess 250.

Unfortunately, the conventional sheet metal drawing equipment has several disadvantages.

More particularly, the sheet metal drawing equipment is so constructed that a support 203 is formed of a single plate material and operation arms 205 each are connected at one end thereof to the support 203. Thus, in order to ensure that the sheet metal drawing equipment effectively carries out various kinds of drawing operations, it is required to form the support 203 into an increased length. Unfortunately, this tends to cause deformation or distortion of the support with progress of operation of the operation arms 205. Such deformation or distortion leads to a failure in operation of the sheet metal drawing equipment.

Also, sheet metal working carried out while contacting surface contact sections 221 of legs 202 with a surface of a sheet metal decreased in stiffness causes depression of a portion of the surface contacted with the contact surface sections 221 of the legs 202 as shown in FIG. 17B, resulting in the recess to be drawn being migrated, for example, from a position indicated at dashed lines 350 in FIG. 18B to that indicated at a solid line 360. In order to avoid such a problem to satisfactorily carry out sheet metal working, it would be effective that the surface contact sections 221 of the legs 202 are placed on a stiff portion 310 of a sheet metal such as a skeleton 310 (FIG. 21) formed by an outer panel 301 of a door 300 of an automobile and an inner panel 302 thereof. However, formation of the support 203 into a length L shown in FIG. 20 fails to ensure that the conventional sheet metal drawing equipment satisfactorily draws not only such a recess at a central portion of a metal sheet as indicated at reference numeral 365 in FIG. 19 but such a recess at an end portion of a metal sheet as indicated at reference numeral 370 in FIG. 20, because a movable rod 215 and the operation arms 205 fail to slide in a longitudinal direction of the support 203 unlike the legs 202. For this purpose, it is required to form the support 203 into a length N (=L+M; N>L) shown in FIG. 20. However, this renders a gravity of the sheet metal drawing equipment unstable and disadvantageously increases a weight thereof, leading to a failure in satisfactory and rapid sheet metal working.

SUMMARY OF THE INVENTION

The present invention has been made in view of the foregoing disadvantage of the prior art.

Accordingly, it is an object of the present invention to provide a sheet metal drawing equipment which is capable of exhibiting strength or stiffness sufficient to substantially prevent deformation thereof during sheet metal working and ensure increased durability.

It is another object of the present invention to provide a sheet metal drawing equipment which is capable of satisfactorily carrying out various kinds of sheet metal working while keeping a side rail means as short as possible and facilitating the working.

It is a further object of the present invention to provide a sheet metal drawing equipment which is capable of permitting sheet metal working to be accurately accomplished while being visually observed.

It is still another object of the present invention to provide a sheet metal drawing equipment which is capable of carrying out setting thereof and sheet metal working with increased operational efficiency even when a side rail means is increased in length.

In accordance with the present invention, a sheet metal drawing equipment is provided. The sheet metal drawing equipment includes a pair of legs each provided with at least one surface contact section which is adapted to be abuttedly contacted with a surface of a sheet metal, a side rail means for slidably supporting the legs thereon, a slide frame means slidably supported on the side rail means and formed at a central portion thereof with a through-hole, a pair of operation arms each pivotally supported at one end thereof on the slide frame means, a central shaft arranged so as to extend in a direction perpendicular to a longitudinal direction of the side rail means, inserted via the through-hole of the slide frame means and moved by operation of the operation arms, and connection arms each arranged in correspondence to each of the operation arms and pivotally connected at one end thereof to corresponding one of the operation arms and at the other end thereof to the central shaft.

In a preferred embodiment of the present invention, the slide arm means, operation arms and central shaft are arranged so as to be integrally slidable in the longitudinal direction of the side rail means.

In a preferred embodiment of the present invention, the side rail means includes two rails arranged in a manner to be parallel to each other, wherein the central shaft is inserted between the rails while being guided by the slide frame means.

In a preferred embodiment of the present invention, the rails of the side rail means are fixedly connected to each other with spacers being arranged at both ends of the rails while being interposed therebetween so that a gap is defined therebetween.

In a preferred embodiment of the present invention, the slide frame means is formed therein with a passage through which the rails of the side rail means are inserted and the slide frame means is formed on a central portion of inner upper and lower surfaces thereof defining the passage with elongated projections in a manner to extend in the longitudinal direction of the side rail means inserted through the slide frame means, wherein the elongated projections cooperate with the spacers to keep the gap between the rails throughout the side rail means.

In a preferred embodiment of the present invention, the side rail means and slide frame means are fixed to each other by threadedly inserting a thumb screw into a body of the slide frame means and then advancing it into the passage to securely abut it against one of the rails while keeping the rails inserted through the passage of the slide frame means.

In a preferred embodiment of the present invention, the operation arms each are positioned on an extension of a plane defined by the two rails.

In a preferred embodiment of the present invention, the sheet metal drawing equipment further includes a drawing depth determination means for determining a depth in which the sheet metal is drawn to a reference plane acting as a standard of drawing of the sheet metal. The drawing depth determination means is arranged in a manner to be suspended from the slide frame means.

In a preferred embodiment of the present invention, the drawing depth determination means includes a measuring bar, a spring fixed at one end thereof on a distal end of the measuring bar, and a contact arranged on a side of a free end of the spring so as to be contacted with a surface of the sheet metal to be drawn.

In a preferred embodiment of the present invention, the measuring bar of the drawing depth determination means is mounted on the slide frame means through a plate-like presser.

In a preferred embodiment of the present invention, the legs each are provided with two such surface contact sections.

In a preferred embodiment of the present invention, the sheet metal drawing equipment further includes a pair of suspension support means for suspendedly supporting a body of the sheet metal drawing equipment.

In a preferred embodiment of the present invention, the suspension support means each include a sucking disc and a connection cord tightly connected at one end thereof to the sucking disc and at the other end thereof to each of the legs. Alternatively, the suspension support means each may include a magnet and a connection rod tightly connected at one end thereof to the magnet and at the other end thereof to each of the legs.

In a preferred embodiment of the present invention, the legs each are provided with one such surface contact section.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
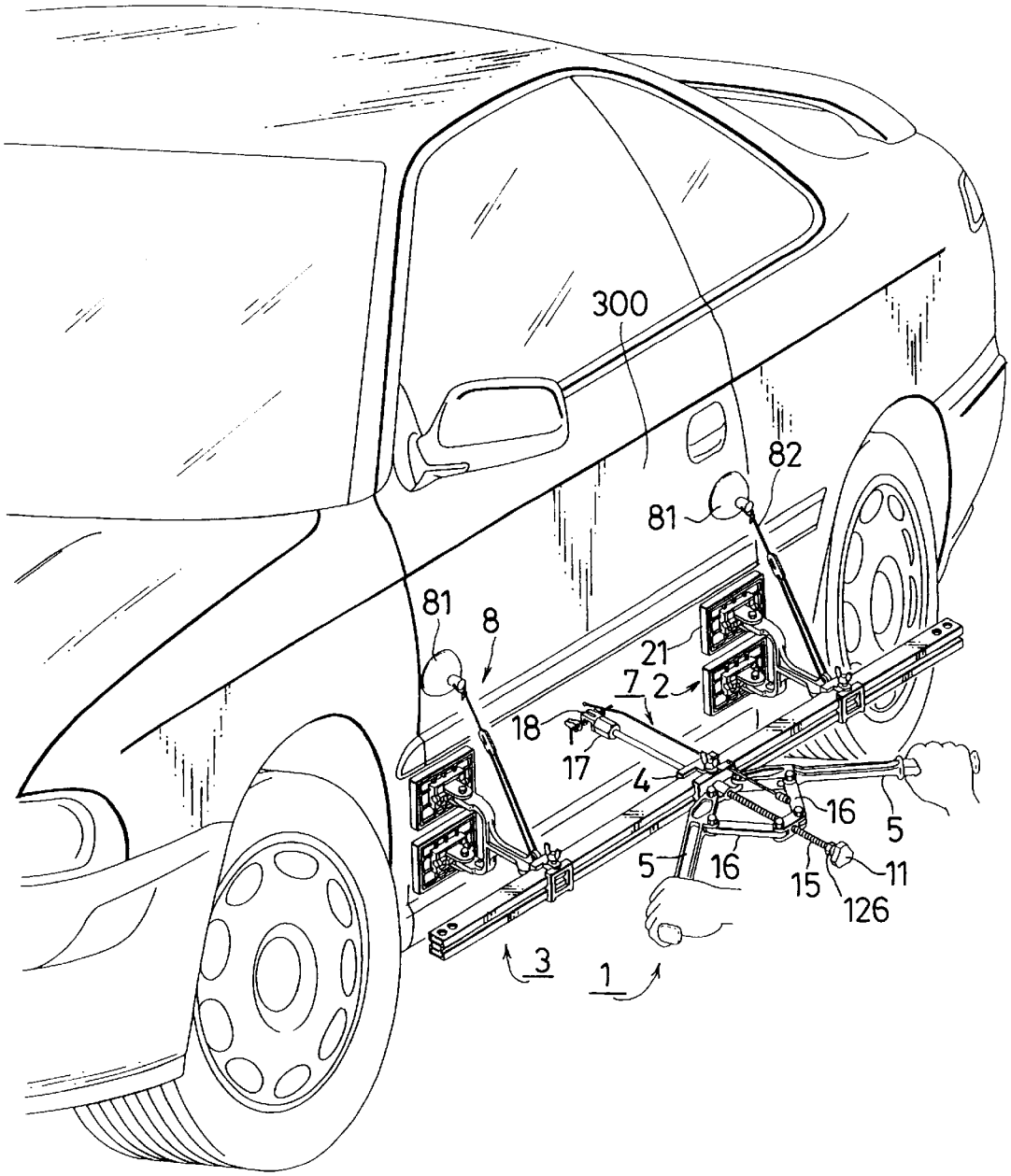
FIG. 1 is a perspective view showing a manner of operation of a sheet metal drawing equipment according to the present invention, which is applied to a body of an automobile.

Now, a sheet metal drawing equipment according to the present invention will be described hereinafter with reference to the accompanying drawings.

Referring first to FIGS. 1 to 13, an embodiment of a sheet metal drawing equipment according to the present invention is illustrated.

A sheet metal drawing equipment of the illustrated embodiment which is generally designated at reference numeral 1 in FIGS. 1 to 13 includes a pair of legs 2 each provided with at least one surface contact section 21 which is adapted to be abuttedly contacted with a surface of a sheet metal to be drawn, a side rail means 3 for slidably supporting the legs 2 thereon, a slide frame means 4 slidably supported on the side rail means 3 and formed at central portion thereof with a through-hole 41, a pair of operation arms 5 each pivotally supported or mounted at one end thereof on the slide frame means 4, a central shaft 15 arranged so as to extend in a direction perpendicular to a longitudinal direction of the side rail means 3, inserted via the through-hole 41 of the slide frame means 4 and moved by operation of the operations arms 5, connection arms 16 each arranged in correspondence to each of the operations arms 5 and pivotally connected at one end thereof to the corresponding operation arm 5 and at the other end thereof to the central shaft 15. In the illustrated embodiment, the slide frame means 4, operations arms 5 and central shaft 15 are arranged so as to integrally slidable in the longitudinal direction of the side rail means 3. Also, in the illustrated embodiment, the legs 2 each provided with two such surface contact sections 21.

Figure 4:
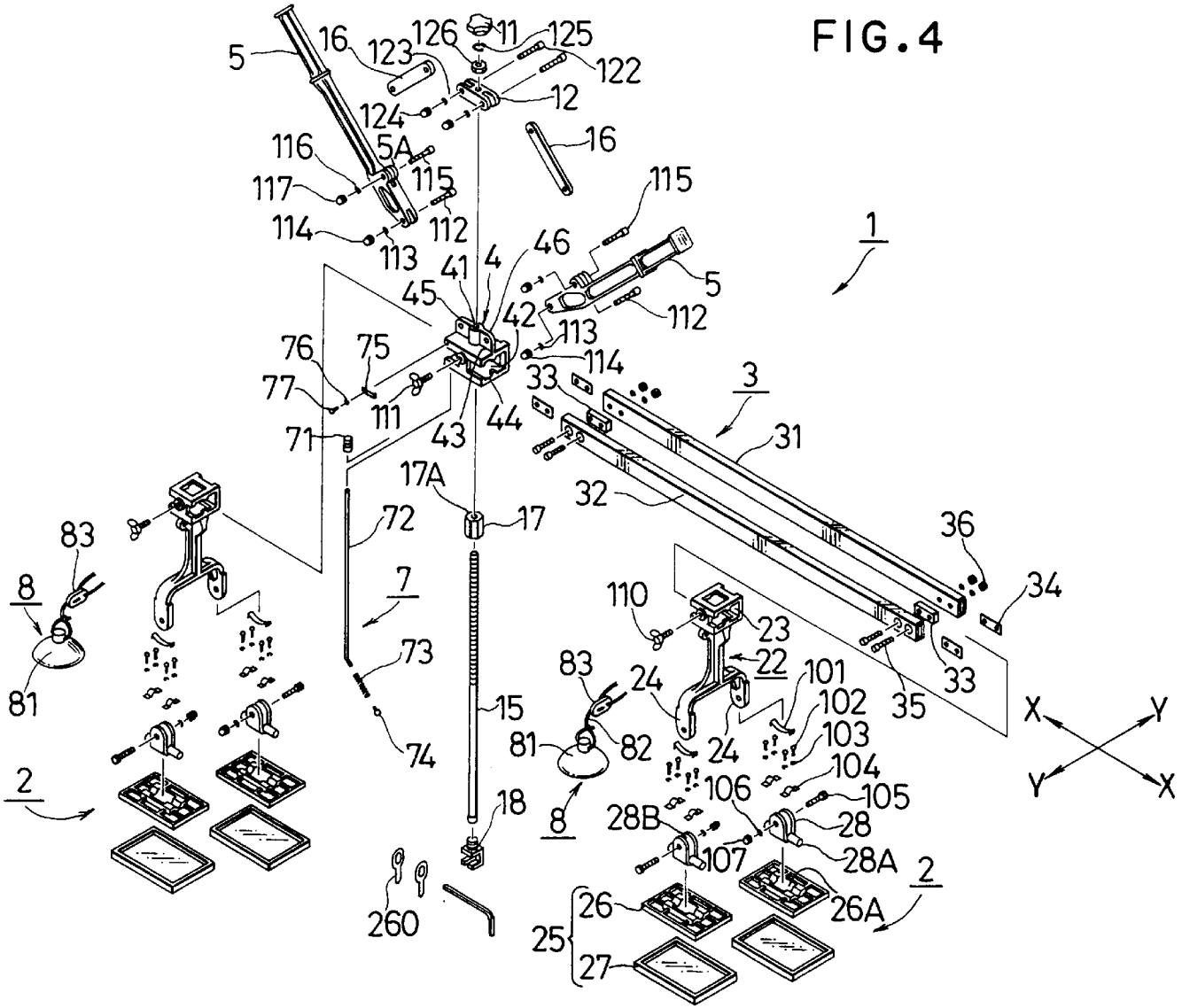
FIG. 4 is an exploded perspective view of the sheet metal drawing equipment shown in FIG. 2.
Figure 7:
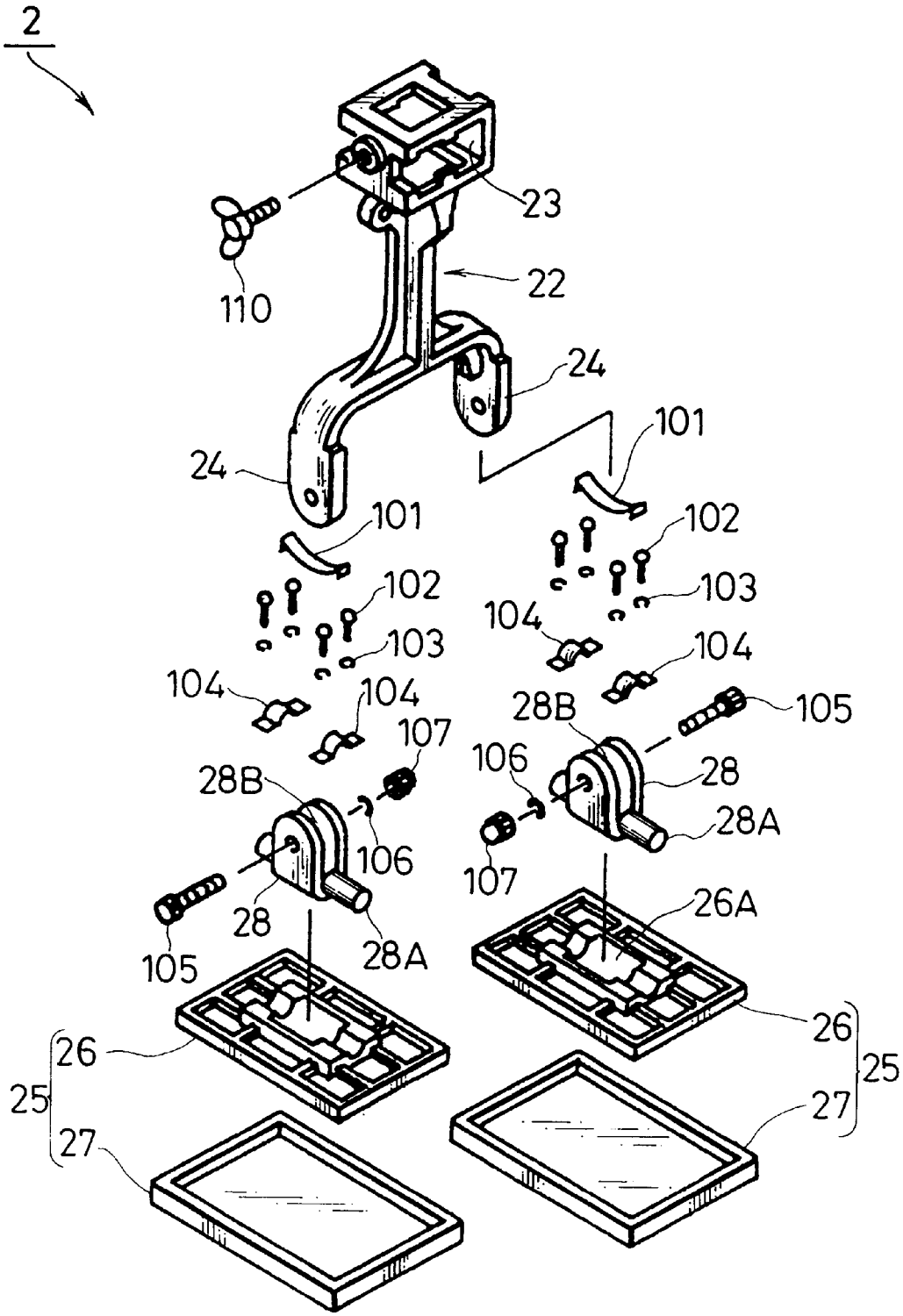
FIG. 7 is an exploded perspective view showing a leg incorporated in the sheet metal drawing equipment shown in FIG. 2.

In the illustrated embodiment, the legs 2 each include a leg body 22 and a pair of pivotal leg members 25 pivotally supported on the leg body 22, as shown in FIGS. 4 and 7, and the surface contact sections 21 are defined on the leg members 25, respectively. The leg body 22 is provided at an upper portion thereof with a scooped-out portion 23 and at a lower portion thereof with a pair of leg elements 24 in a manner to be bifurcated. The pivotal leg members 25 each include a leg board 26 and a frame 27 made of a rubber material so as to act as a pad and arranged so as to surround a periphery of the leg board 26. The leg body 22 and each of the pivotal leg members 25 are connected to each other through a connection member 28. The connection members 28 each include a small shaft 28A and is formed at a central portion thereof with a guide groove 28B upwardly open. The connection members 28 each are received in a recess 26A formed at a central portion of the leg board 26 while covering the small shaft 28A with a presser fitment 104 and then fixed on the leg board 26 through washers 103 by means of screws 102. The guide groove 28B has a tension spring 101 received therein and then each of the leg elements 24 is abutted against the tension spring 101, resulting in the connection member 28 being pivotally connected through the leg element 24 to the leg body 22 by means of a bolt 105, a washer 106 and a nut 107. Thus, the pivotal leg members 25 of the leg 2 are pivotally supported on the lower portion of the leg 2 so as to be pivotally moved in all directions including X—X directions (FIG. 4) defined along a longitudinal axis of the side rail means 3 and Y—Y directions thereof perpendicular to the X—X directions.

Also, the leg 2 may be fixed with respect to the side rail means 3 in such a manner that a thumb screw 110 is advanced into the scooped-out portion 23, to thereby be abutted against a rail 32 of the side rail means 3 described hereinafter while extending the side rail means 3 through the scooped-out portion 23.

The legs 2 are arranged so as to be spaced from each other at an interval S (FIGS. 8 and 9), which may be suitably selectively determined to be optimum depending on a portion of a sheet metal to be drawn and a state of the surface contact section 21. For example, the interval S may be set so as to permit the surface contact section 21 to be positioned at a drawn portion of the sheet metal exhibiting the strongest nerve or stiffness.

Figure 2:
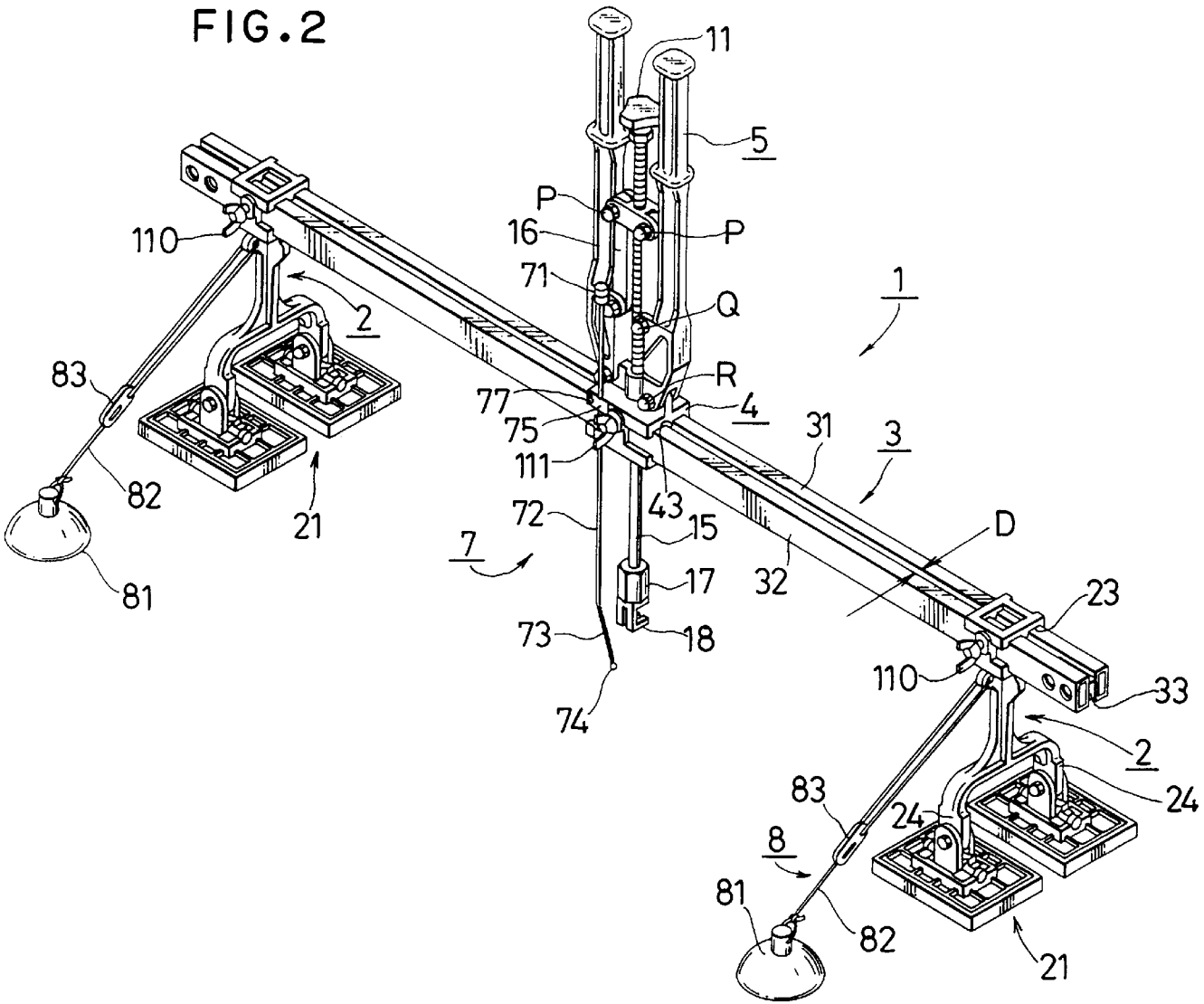
FIG. 2 is a perspective view showing an embodiment of a sheet metal drawing equipment according to the present invention.
Figure 10:
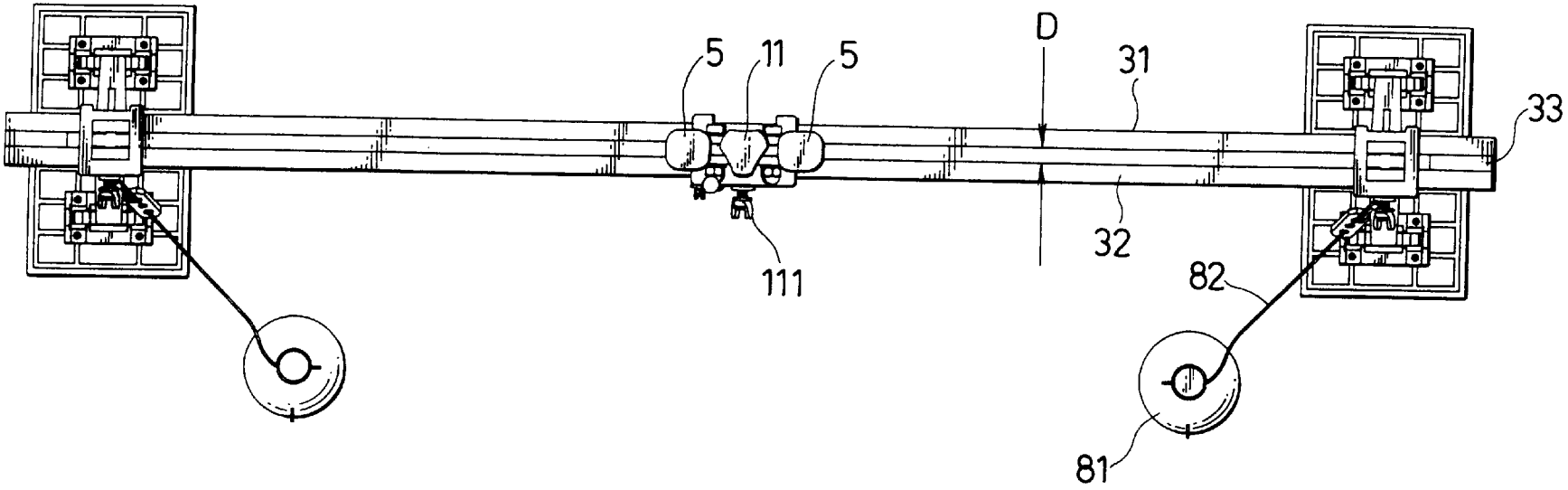
FIG. 10 is a plan view of the sheet metal drawing equipment shown in FIG. 2.
Figure 11:
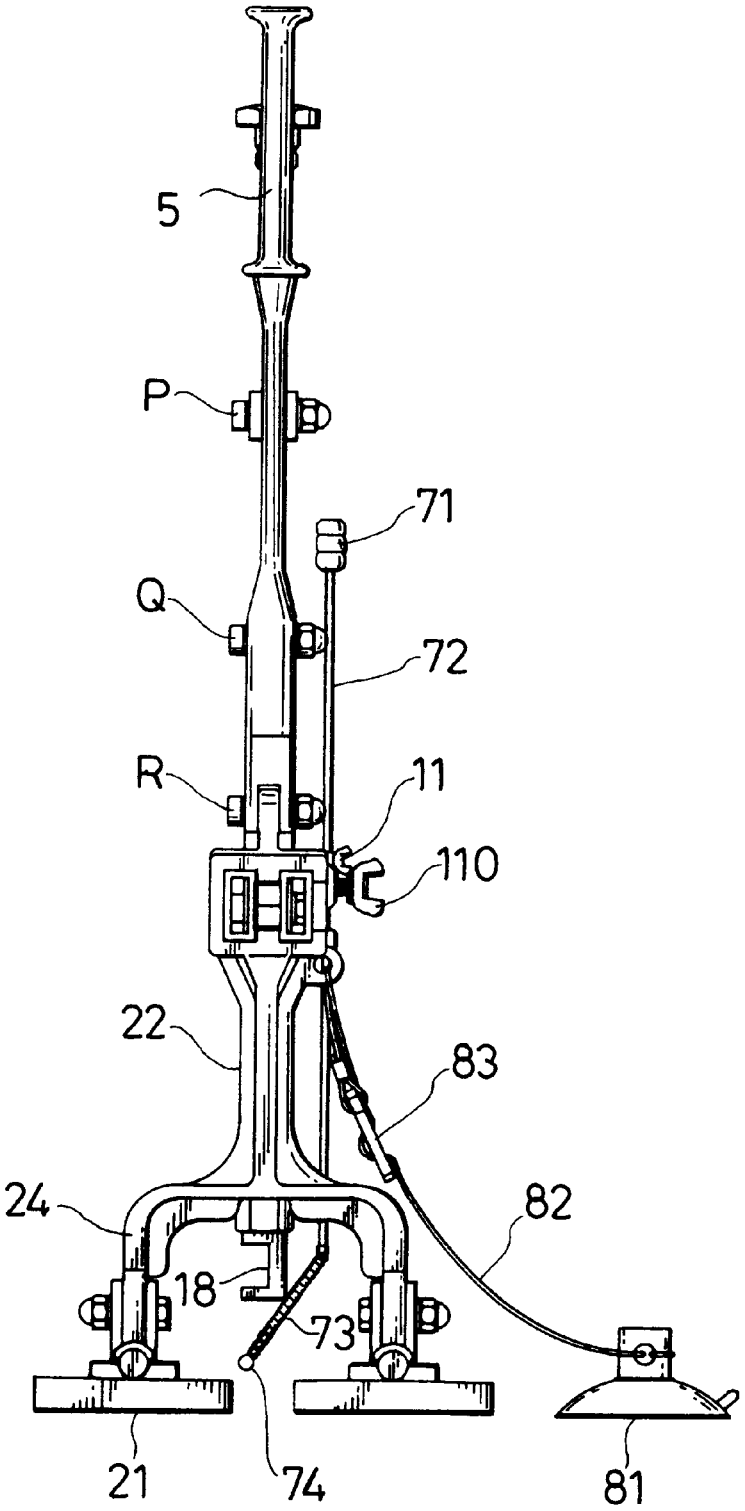
FIG. 11 is a side elevation view of the sheet metal drawing equipment shown in FIG. 2.
Figure 12:
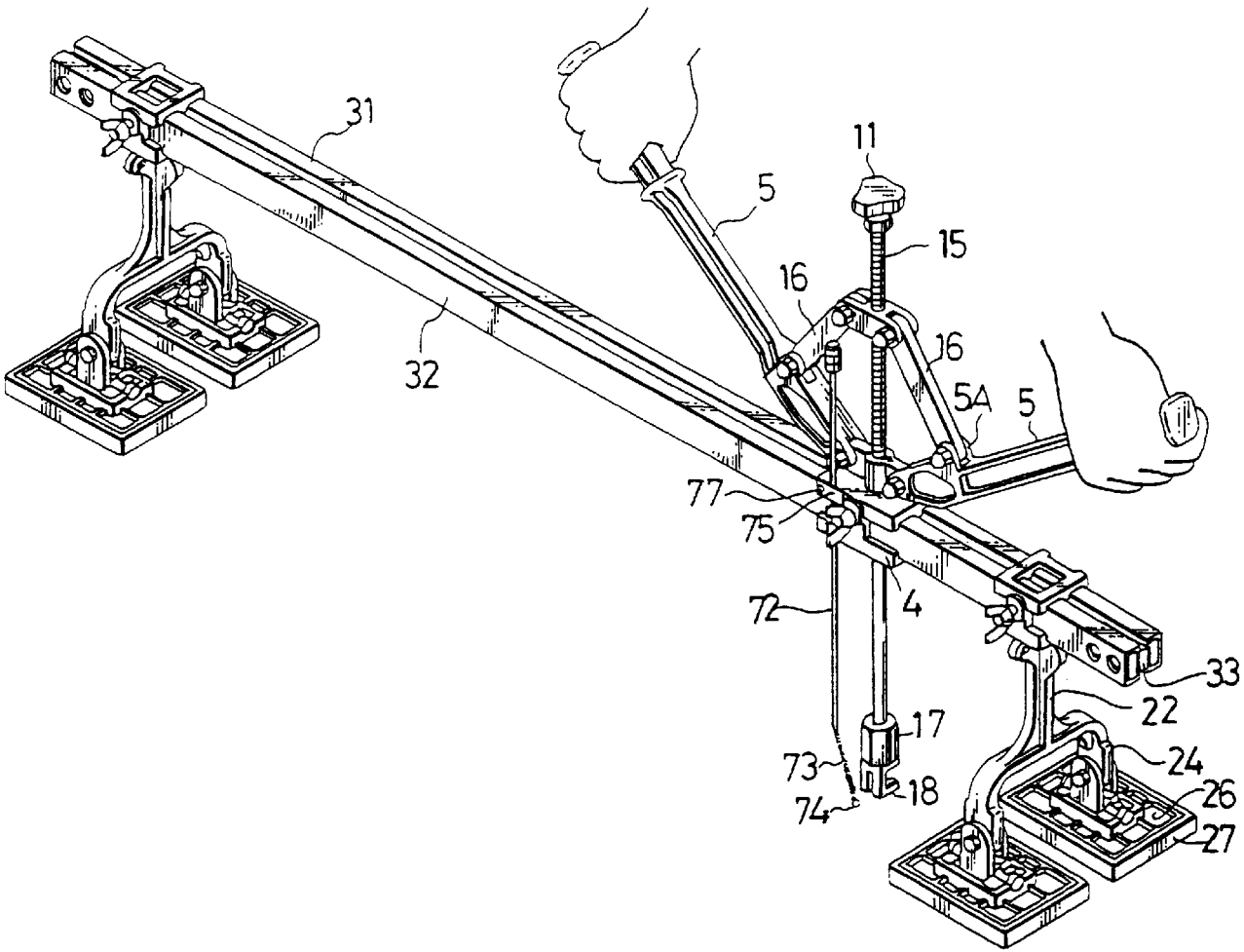
FIG. 12 is a perspective view showing a manner of operation of operation arms incorporated in the sheet metal drawing equipment shown in FIG. 2.
Figure 13:
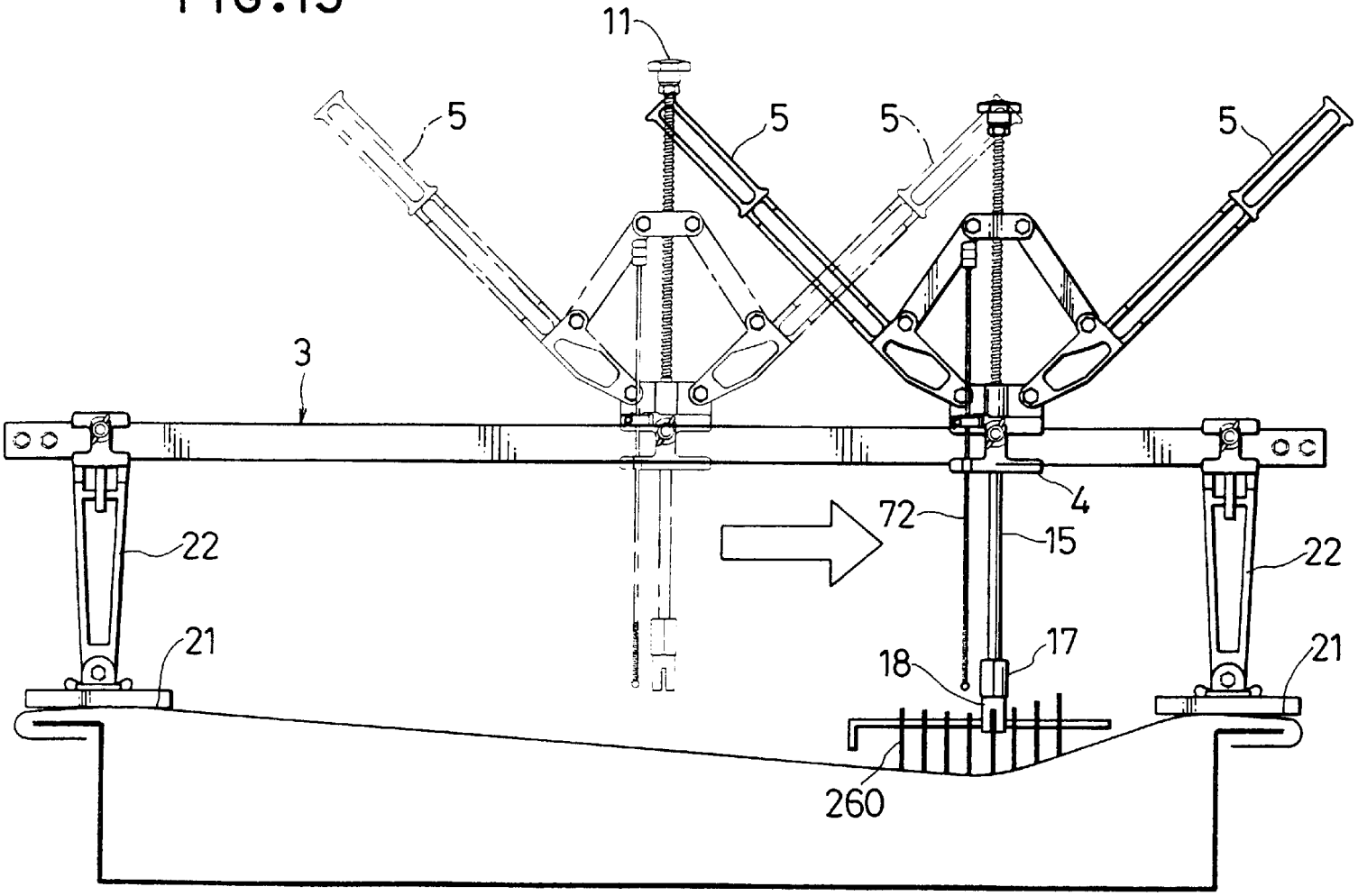
FIG. 13 is a front elevation view showing an essential part of a slide frame means incorporated in the sheet metal drawing equipment shown in FIG. 2, which is kept slid to a surface.

The side rail means 3 includes the rail 32 briefly described above and a rail 31 arranged in parallel to the rail 32. Between the rails 31 and 32 is arranged the central shaft 15 so as to extend in a direction perpendicular to the rails 31 and 32 while being guided by the slide frame means 4 as shown in FIG. 2. Also, the rails 31 and 32 have spacers 33 arranged therebetween at both ends thereof, resulting in a gap D being defined between the rails 31 and 32 as shown in FIG. 10, through which both rails are fixed to each other by means of bolts 35 and nuts 36. Reference numeral 34 designates stiffening plate members for reinforcing the rails 31 and 32, which are fixed to the rails likewise by means of the bolts 35 and nuts 36.

Figure 5:
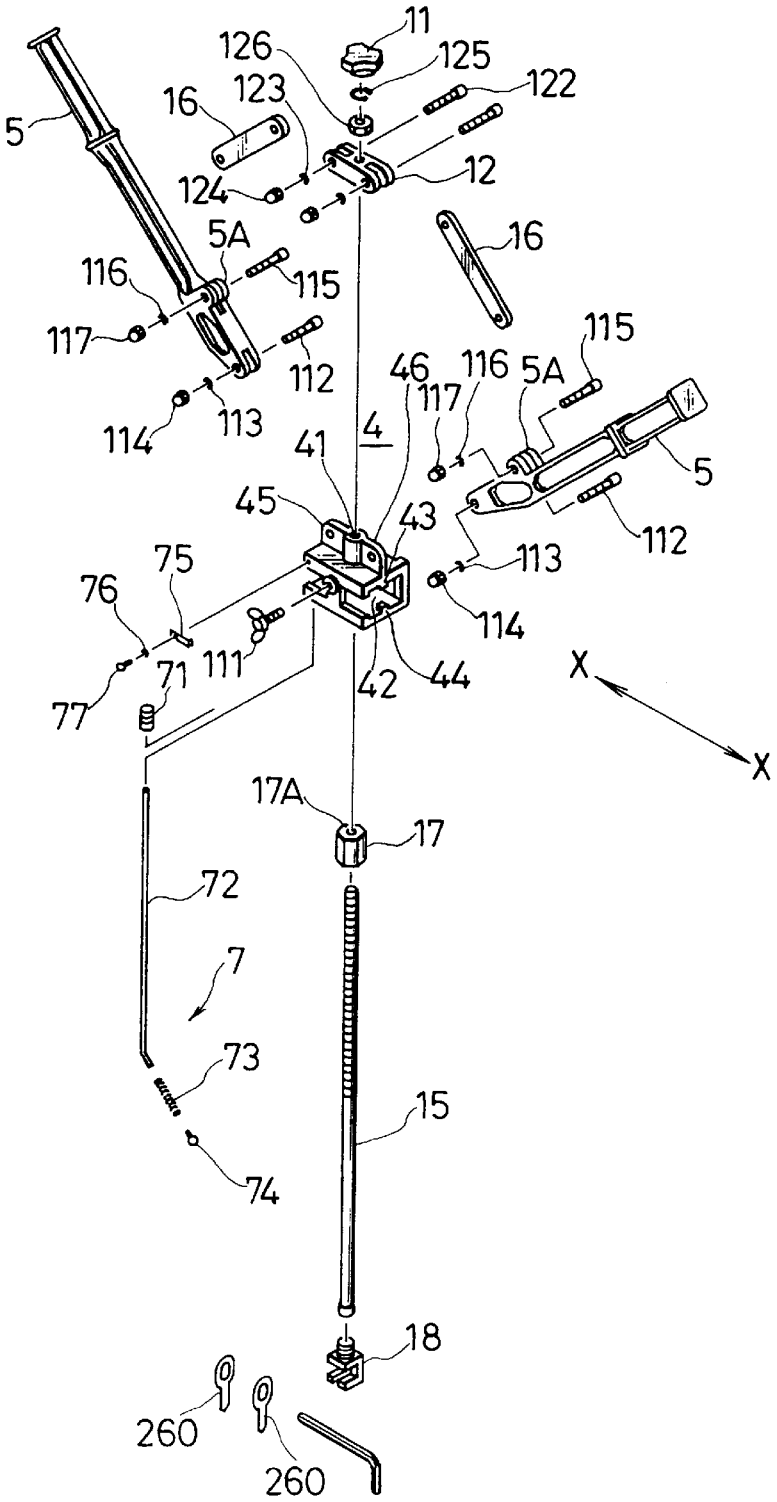
FIG. 5 is an exploded perspective view showing a slide frame means, operations arms, a central shaft and connection arms incorporated in the sheet metal drawing equipment shown in FIG. 2.
Figure 6:
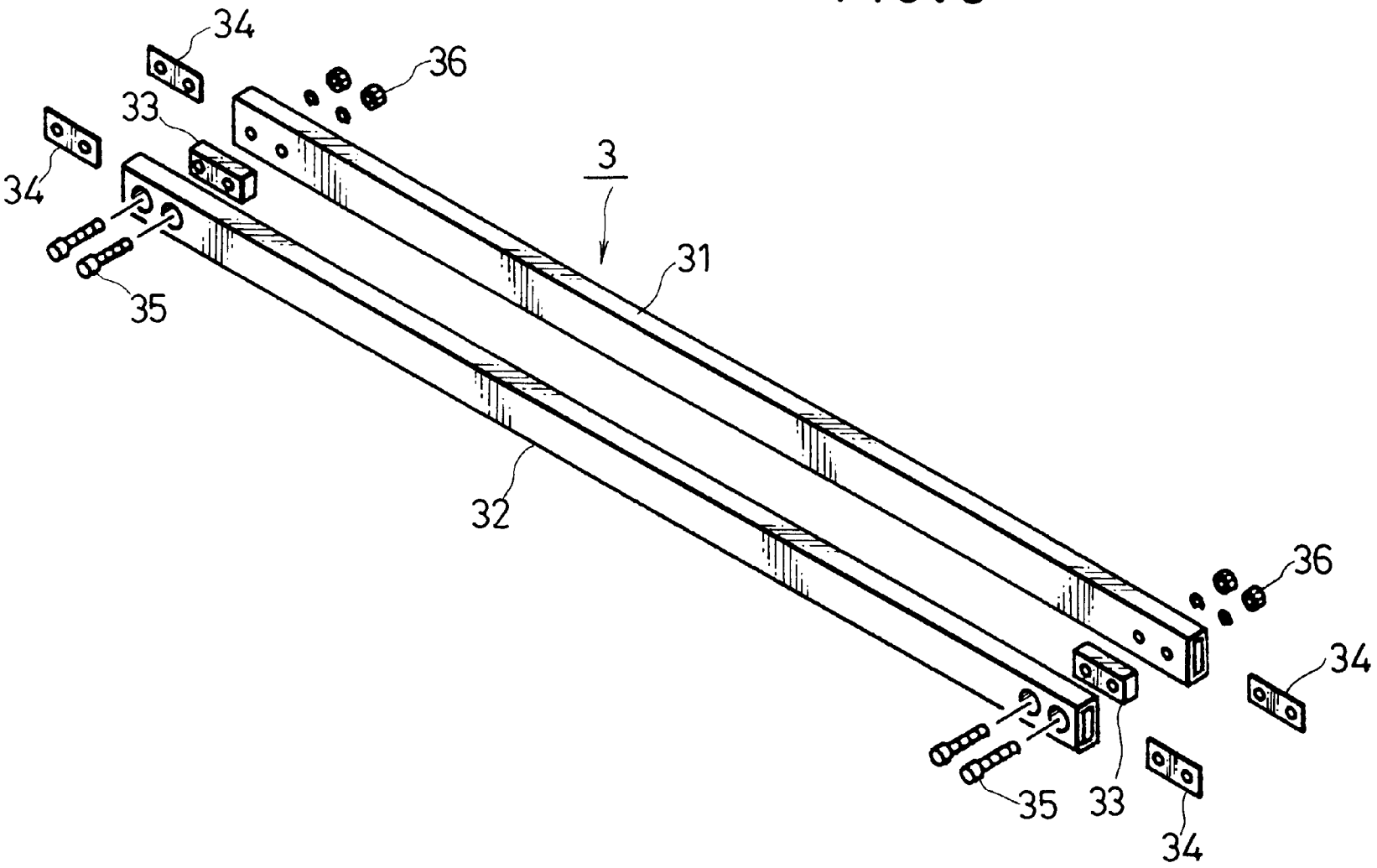
FIG. 6 is an exploded perspective view showing a side rail means incorporated in the sheet metal drawing equipment shown in FIG. 2.

The slide frame means 4, as shown in FIGS. 4 and 5, is formed therein with a passage 42 and the rails 31 and 32 are arranged so as to extend through the passage 42. The slide frame means 4 is formed on inner upper and lower inner surfaces thereof defining the passage 41 with elongated projections 43 and 44 in a manner to extend in a direction parallel to a longitudinal direction of the rails 31 and 32 inserted through the slide frame means 4. The projections 43 and 44 cooperate with the spacers 33 to permit the gap D to be kept between the rails 31 and 32 throughout the side frame means 3. Also, the slide frame means 4 is formed thereon with raised portions 45 and 46, which cooperate with each other to define the above-described through-hole 41 therein. The raised portions 45 and 46 are arranged so as to extend in the longitudinal direction of the side rail means 3 inserted through the slide frame means 4 or in the X—X directions shown in FIG. 4 and 5 while being aligned with each other. The operations arms 5 are pivotally mounted at a proximal end thereof on the raised portion 45 and 46 by means of bolts 112, washers 113 and nuts 114, respectively.

Fixing between the side rail means 3 and the slide frame means 4 may be carried out by threadedly inserting a thumb screw 111 into a body of the slide frame means 4 and then advancing it into the passage 42 to securely abut it against the rail 32 while keeping the rails 31 and 32 inserted through the passage 42 of the slide frame means 4.

Thus, slide movement of the slide frame means 4 permits the operation arms 5 and central shaft 15 to be moved to any desired position optimum for sheet metal working, so that sheet metal drawing may be satisfactorily accomplished even when a length of the side rail means 3 is minimized, resulting in the sheet metal drawing equipment of the illustrated embodiment being significantly reduced in weight.

The operation arms 5, as described above, each are pivotally supported at the proximal end thereof on the slide frame means 4. More specifically, the operation arms 5 each are formed at a portion thereof somewhat above the proximal end thereof with an extension 5A as shown in FIGS. 3, 4, 5 and 12, which is then pivotally supported or mounted on one end of the connection arm 16 by means of a bolt 115, a washer 116 and a nut 117 as shown in FIG. 4. Thus, the operation arm 5 is positioned on an extension of a plane defined by the two rails 31 and 32. Such construction of the illustrated embodiment effectively prevents deformation or distortion of the side rail means 3 during sheet metal drawing or working and permits a gravity of the sheet metal drawing equipment to be stabilized.

The sheet metal drawing equipment of the illustrated embodiment further includes a drawing depth determination means 7 for determining an amount or depth in the sheet metal is drawn to a reference plane acting as a standard of drawing of the sheet metal. The drawing depth determination means 7 is arranged on the slide frame means 4 so as to be suspended therefrom. The drawing depth determination means 7 includes a knob or lug 71, a measuring bar 72 connected at a proximal end thereof to the lug 71, a spring 73 fixed on a distal end of the measuring bar 72, and a contact 74 formed of a tip ball and arranged at a free end of the spring 73 so as to be contacted with a drawn surface of the sheet metal. The measuring bar 72 is mounted on the slide frame means 4 through a plate-like presser 75 secured to the slide frame means 4 by means of a washer 76 and a screw 77. Thus, the drawing depth determination means 7 ensures that a degree of drawing of the drawn surface to the reference plane is visually determined or confirmed during the drawing operation, so that the operation may be appropriately accomplished.

Figure 3:
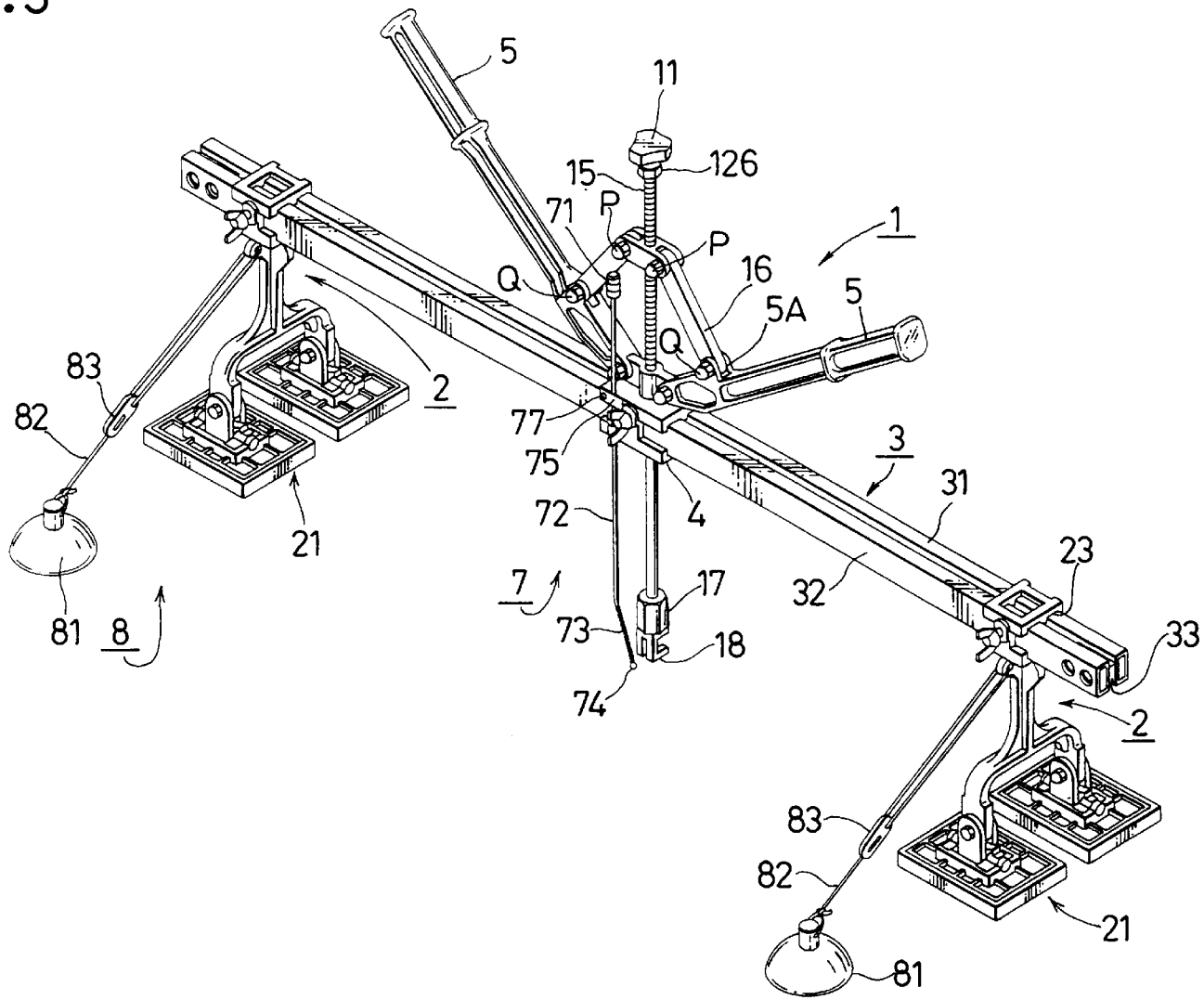
FIG. 3 is a perspective view of the sheet metal drawing equipment shown in FIG. 2 in which operation arms are pivotally moved apart from each other.

Further, the sheet metal drawing equipment of the illustrated embodiment, as shown in FIGS. 2 to 4, includes a pair of suspension support means 8 for suspendedly supporting a body of the sheet metal drawing equipment. The suspension support means 8 each include a sucking disc 81 and a connection cord 82 tightly connected at one end thereof to the sucking disc 81 and at the other end thereof to the leg 2. Reference numeral 83 designates a connection cord adjusting means for adjusting a length of the connection cord 82.

Such arrangement of the suspension support means 8 facilitates setting of the sheet metal drawing equipment and sheet metal working even when the side rail means 3 is formed into an increased length.

The central shaft 15 is formed on an upper half thereof with threads as shown in FIG. 5, so that rotation or operation of a handle 11 mounted on an upper end of the central shaft 15 permits a length h (FIG. 8) of a portion of the central shaft 15 projected from the through-hole 4 of the slide frame means 4 to be adjusted as desired. Reference numeral 12 designates a vertically moving member which is formed at a central portion thereof with an internally-threaded through-hole through which the central shaft 15 is threadedly inserted and on which the connection arms 16 each are pivotally mounted at the other end thereof by means of a bolt 122, a washer 123 and a nut 124 as shown in FIGS. 4 and 5. Also, the central shaft 15 is connected at a lower end thereof to an attachment 18 by means of a shell 17 formed with an internally-threaded through-hole 17A. The shell 17 is threadedly fitted at the internally-threaded through-hole 17A thereof on the attachment 18. The through-hole 17A is formed into a diameter larger than that of the central shaft 15, so that the central shaft 15 is freely inserted via the through-hole 17A. Reference numeral 125 designates a washer and 126 is a nut.

Figure 8:
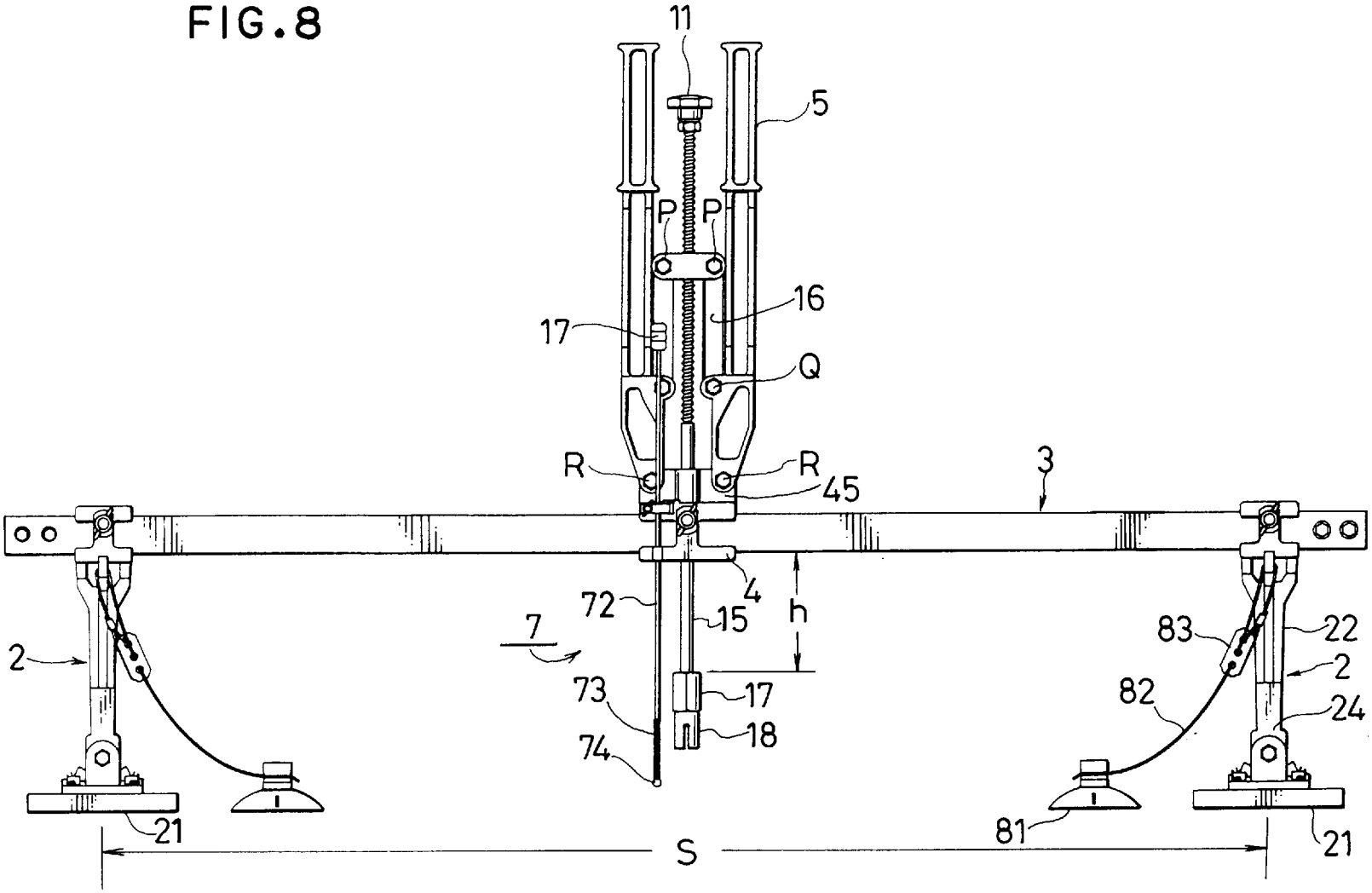
FIG. 8 is a front elevation view of the sheet metal drawing equipment shown in FIG. 2.
Figure 9:
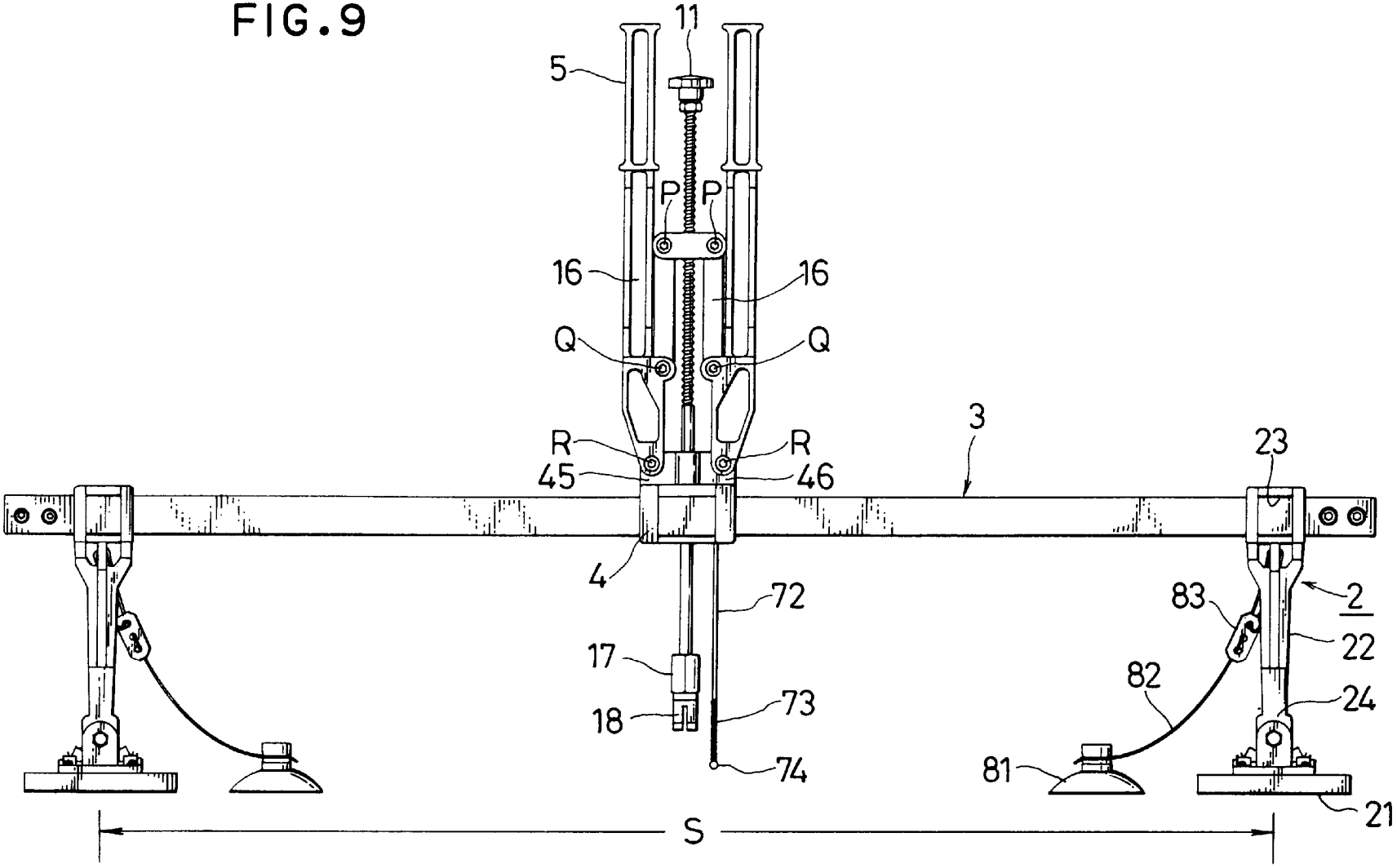
FIG. 9 is a rear elevation view of the sheet metal drawing equipment shown in FIG. 2.

Thus, when the operation arms 5 are operated to cause a center R of pivotal movement of the operation arms 5 to be aligned with points P and Q at which the connection arms 16 are pivotally mounted on a straight line, the central shaft 15 reaches the uppermost position. This causes both operation arms 5 to be at a state just before they are rendered parallel with each other. Then, when the operation arms 5 are further operated to a position of being closed with respect to each other, resulting in being rendered parallel with each other as shown in FIGS. 2, 8 and 9, the central shaft 15 is somewhat downwardly moved, to thereby be locked by the operation arms 5 and connection arms 16.

Figure 14:
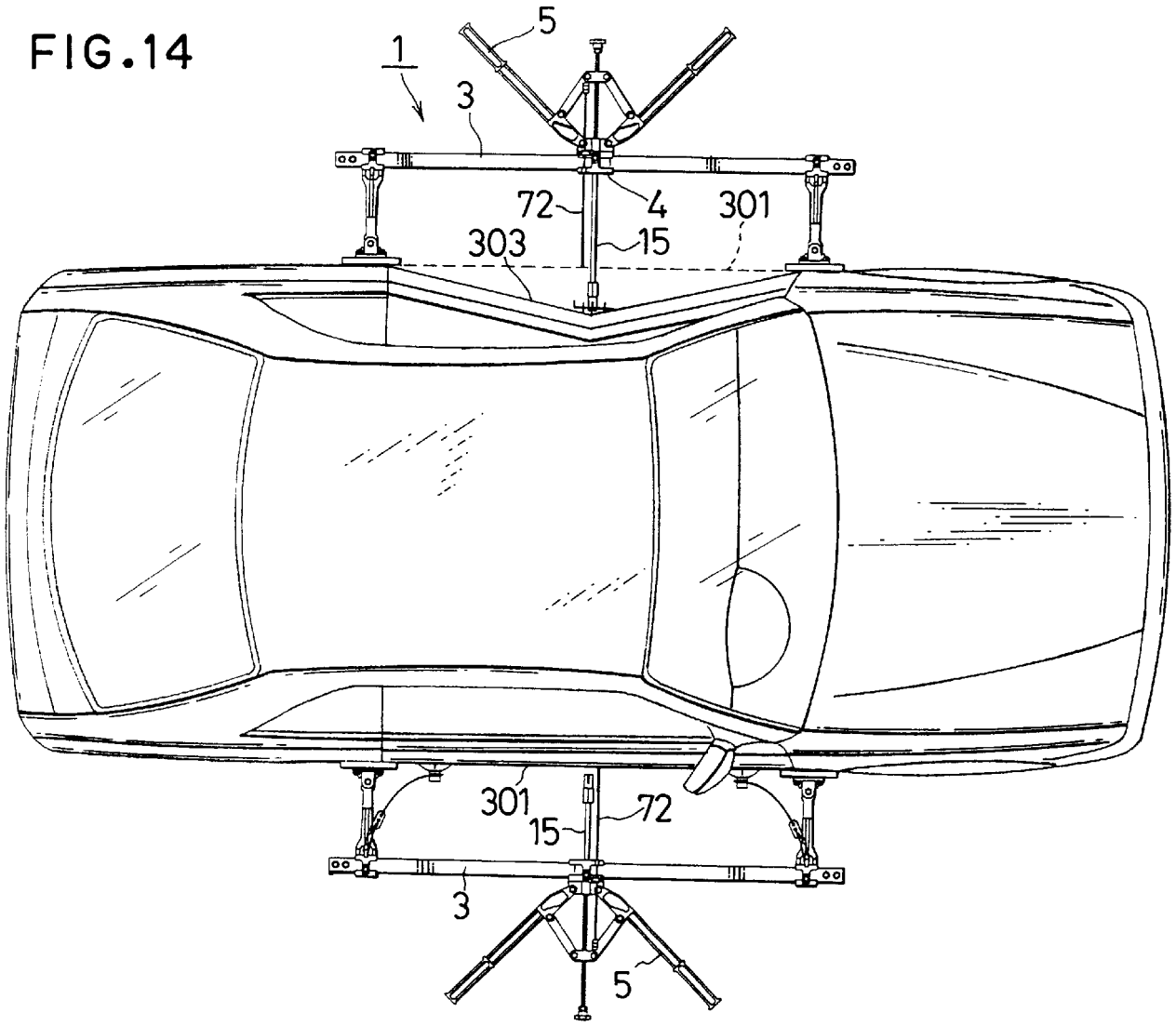
FIG. 14 is a schematic plan view showing a manner of operation of a drawing depth determination means incorporated in the sheet metal drawing equipment shown in FIG. 2.
Figure 21A:
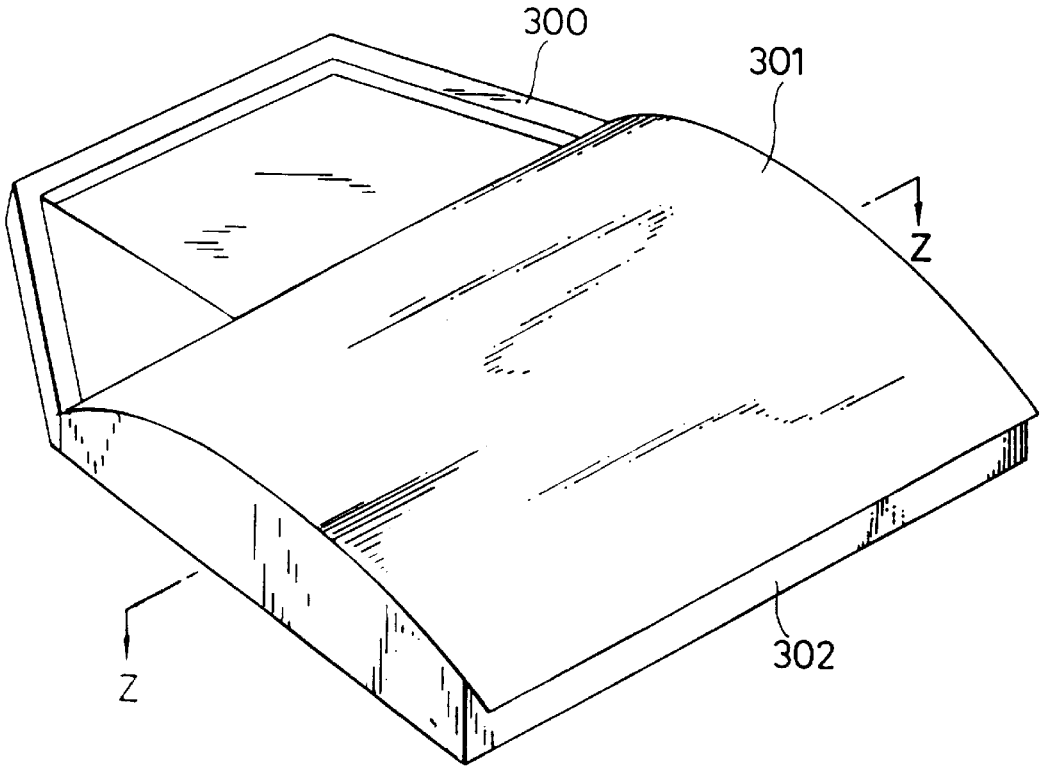
FIG.21(A) PRIOR ART
FIG. 21A is a schematic perspective view showing a door of an automobile.
Figure 21B:
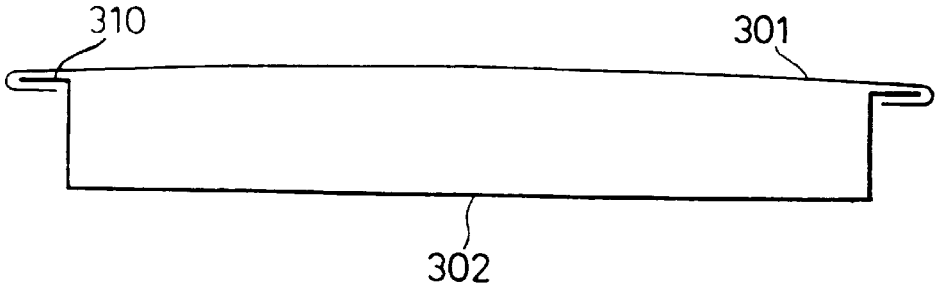
FIG.21(B) PRIOR ART
FIG. 21B is a schematic sectional view taken along line Z—Z of FIG. 21A.

Now, the manner of operation of the sheet metal drawing equipment of the illustrated embodiment thus constructed will be described hereinafter with reference to FIGS. 14 and 15, which show drawing of a recess 303 occurring on an outer panel 301 of a door 300 of an automobile (FIGS. 1 and 21).

First, the interval S between the legs 2 is adjusted as desired and then the sheet metal drawing equipment 1 is suspendedly supported on an opposite door 300 which is not required to be subject to drawing by means of the suspension support means 8.

Then, the slide frame means 4 is slidly moved, to thereby cause the contact 74 of the drawing depth determination means 7 to be positioned at a position right above a position corresponding to the recess 303 to be drawn. At this state, the spring 73 and presser 75 are adjusted to cause the contact 74 to be contacted with the outer panel 301 of the door 300.

Subsequently, the sheet metal drawing equipment 1 which has been subject to the above-described operation is transferred to the outer panel 301 of the door 300 of the automobile which is required to be subject to sheet metal working. Then, the suspension support means is operated to locate the surface contact sections 21 of the legs 2 on a stiff area of the outer panel 301 of the door 300 adjacent to the recess 303 such as a skeleton section formed by the outer panel 301 and inner panel 302 of the door 300 as shown in FIG. 21.

Then, the slide frame means 4 is slidly moved, so that the drawing depth determination means 7 may be positioned right above the recess 303 to be drawn.

Figure 15:
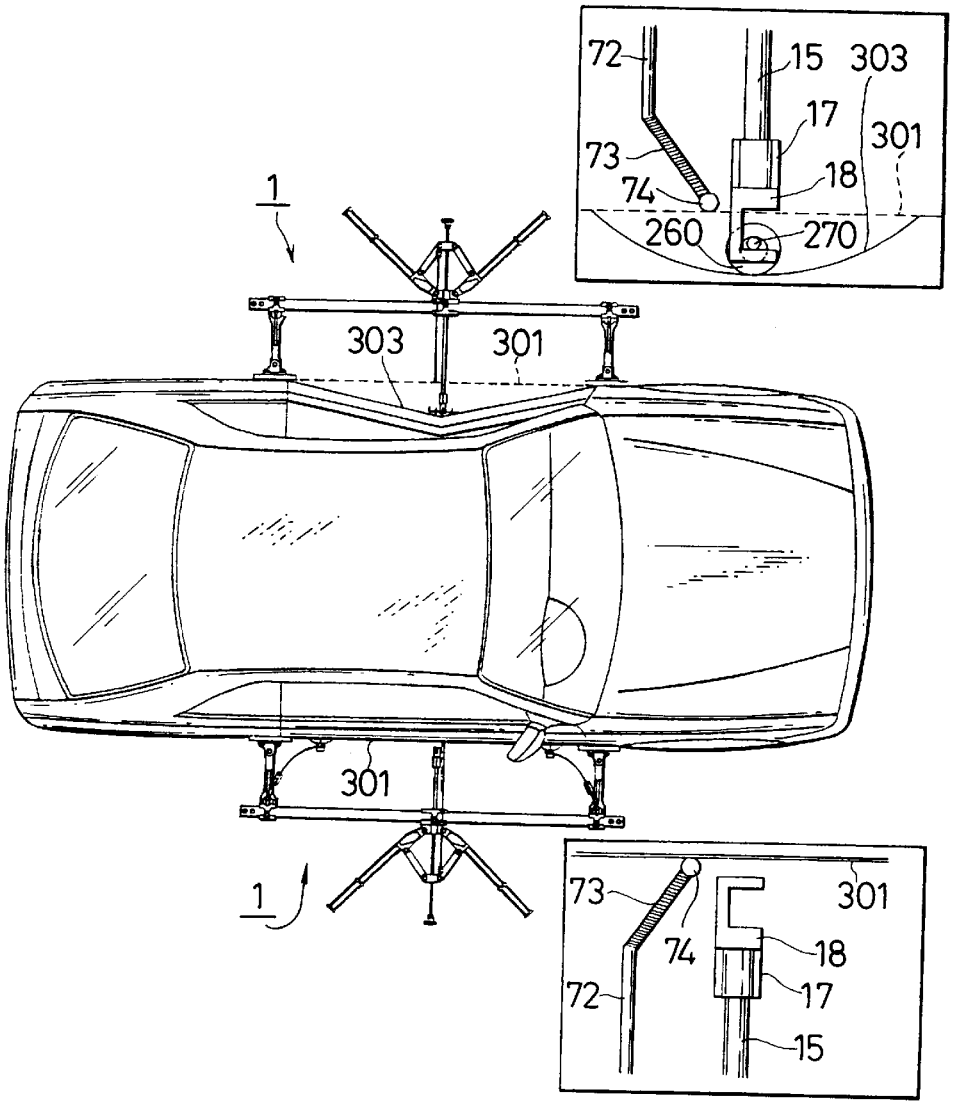
FIG. 15 is a schematic plan view showing a manner of operation of a drawing depth determination means incorporated in the sheet metal drawing equipment shown in FIG. 2 wherein each of essential parts of the drawing depth determination means enclosed with a square.

Thereafter, the handle 11 of the central shaft 15 is operated to adjust a length h of the portion of the central shaft 15 projected from the through-hole 41 of the slide frame means 4, to thereby engage washers 260 welded to the recess 303 with the attachment 18 through a cross bar 270, as shown in FIG. 15.

Then, grips of the operation arms 5 are grasped by hands and gradually moved toward the central shaft 15, to thereby be closed with respect to each other, resulting in abutting the contact 74 against a surface of the recess 303 and further the recess being drawn outwardly or upwardly in FIG. 15 to a degree sufficient to permit the contact 74 to be somewhat upwardly pushed in view of the return. At this time, the central shaft 15 is lifted due to a lever action, to thereby cause the washers 260 to be upwardly drawn, resulting in the recess 303 being drawn out. During the operation, the washers 260 each have uniform force kept applied thereto, so that the recess 303 may be uniformly drawn out. This results in the surface of the recess 303 being rendered smooth. Reaction force of the force for drawing out the recess 303 is dispersed to the surface contact sections 21. Closing of the operation arms 5 with respect to each other leads to locking of the central shaft 15, to thereby ensure that tapping and heating are carried out while keeping the recess 303 pulled, leading to smooth drawing of the recess 303.

Figure 16:
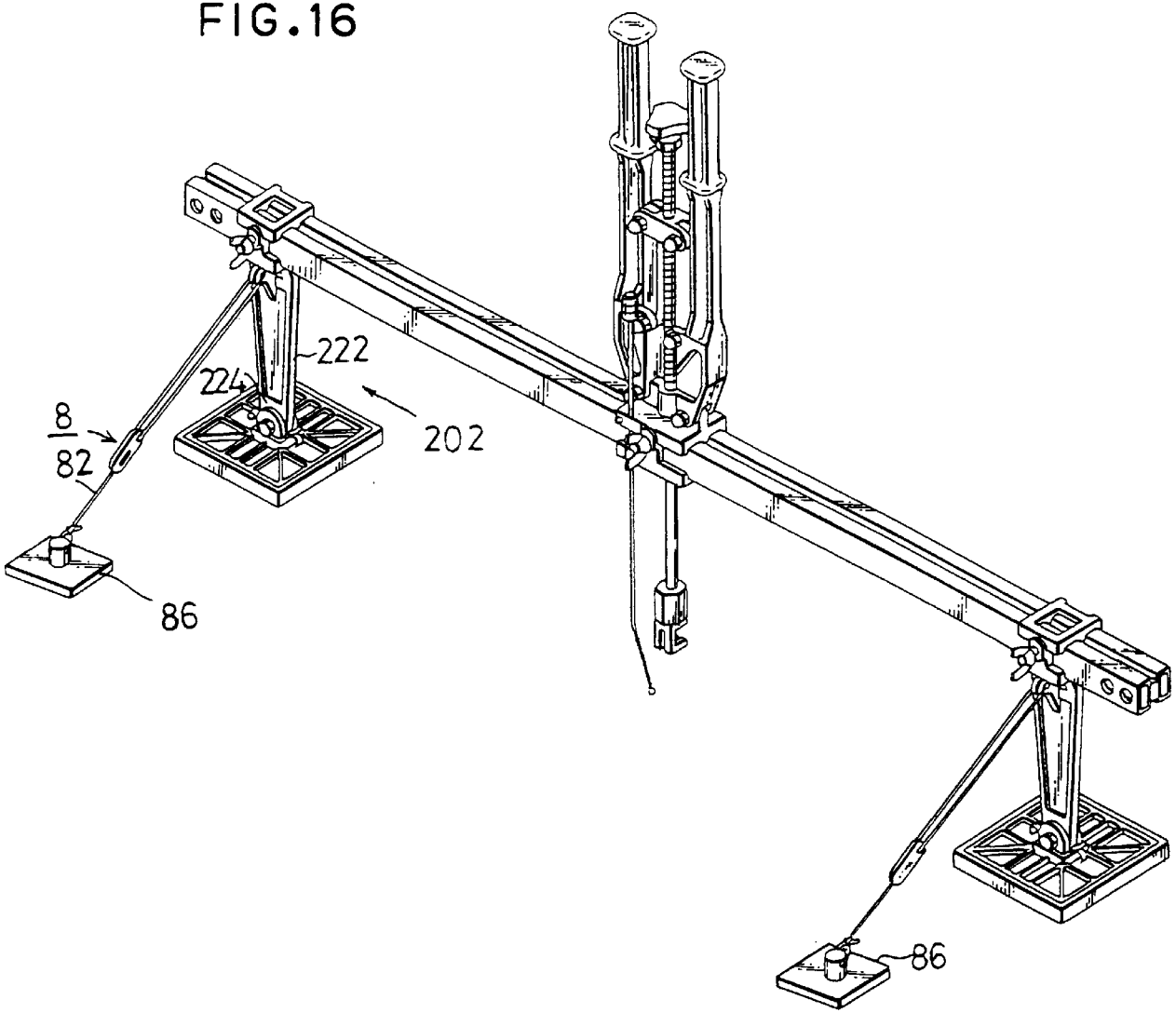
FIG. 16 is a perspective view showing another embodiment of a sheet metal drawing equipment according to the present invention.
Figure 17A:
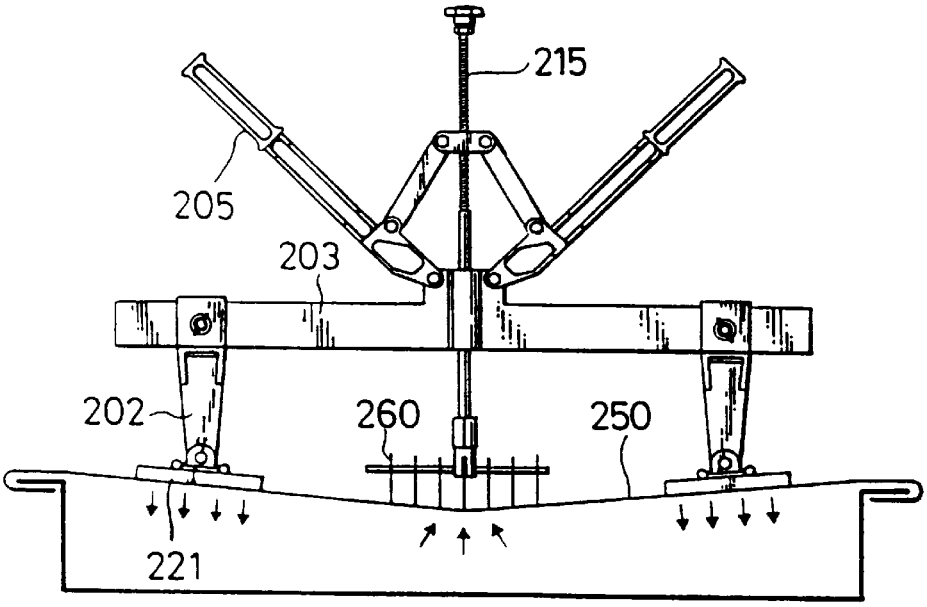
FIG.17(A) PRIOR ART
FIGS. 17A and 17B each are a front elevation view showing a manner of operation of a conventional sheet metal drawing equipment.
Figure 17B:
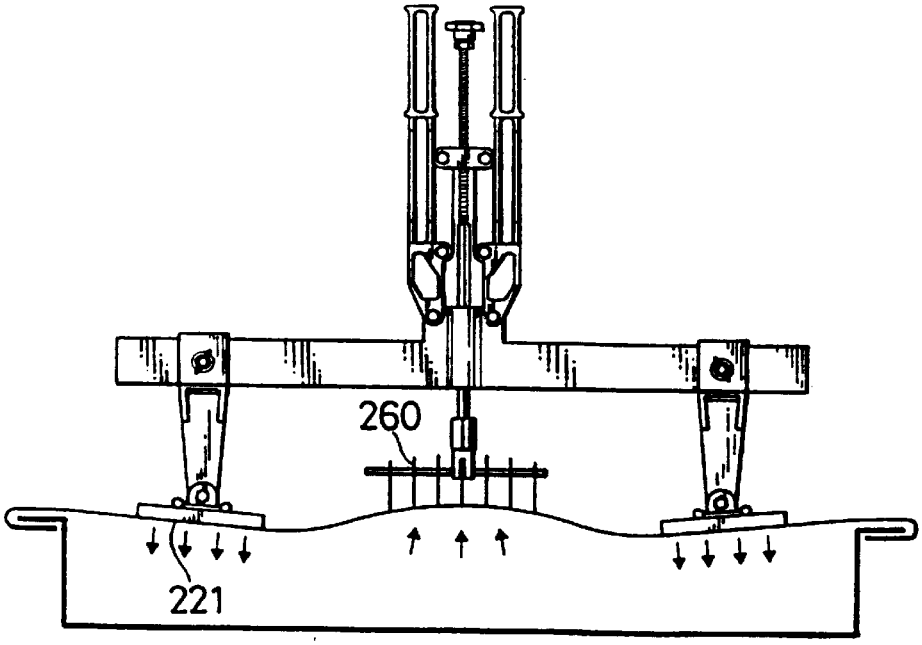
FIG.17(B) PRIOR ART
Figure 18A:
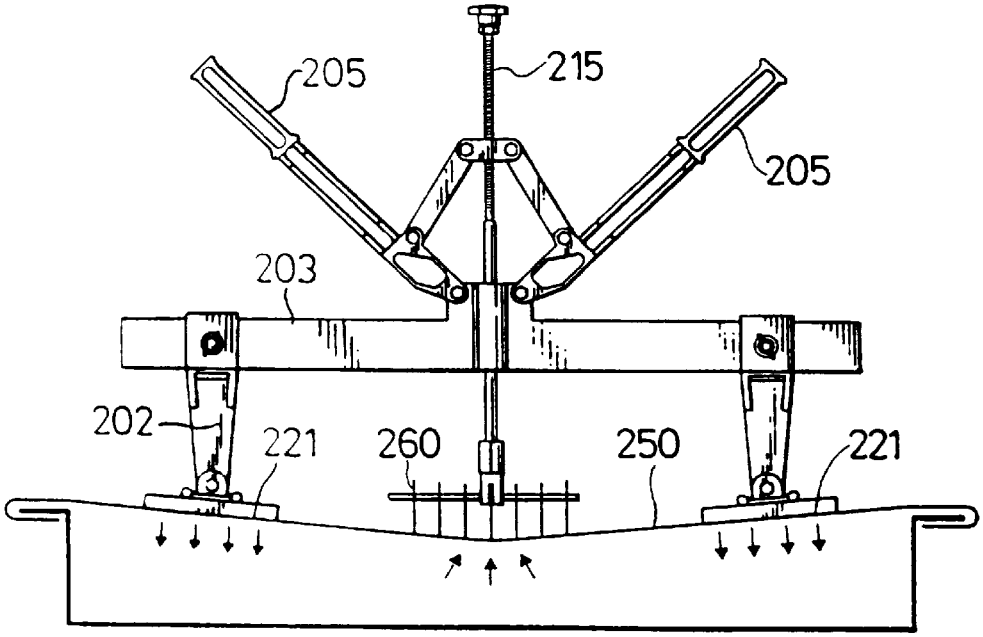
FIG.18(A) PRIOR ART
FIGS. 18A and 18B each are a front elevation view showing another manner of operation of a conventional sheet metal drawing equipment.
Figure 18B:
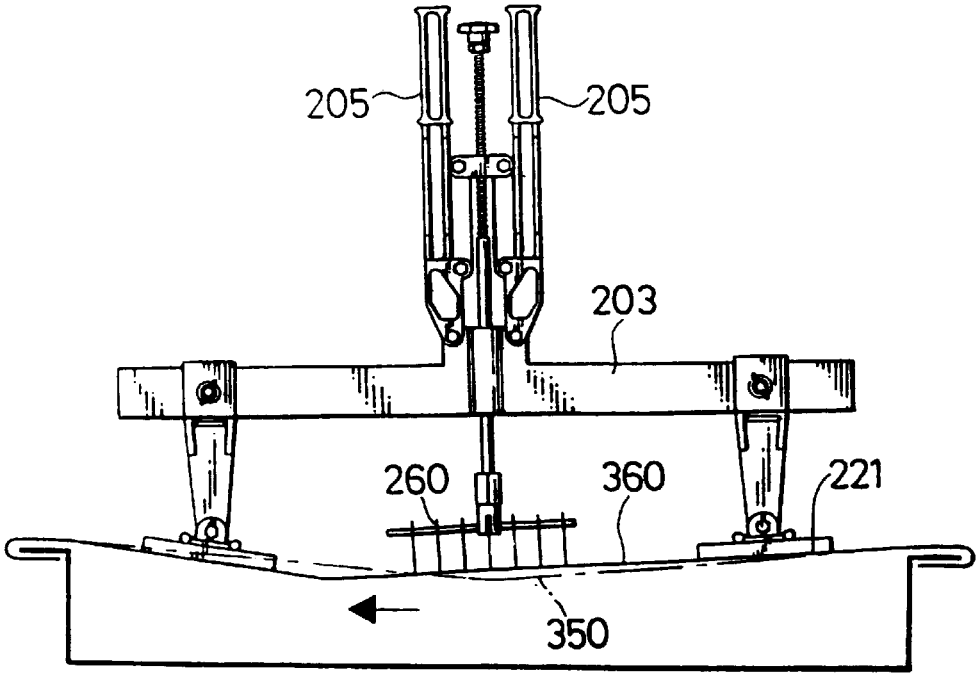
FIG.18(B) PRIOR ART
Figure 19:
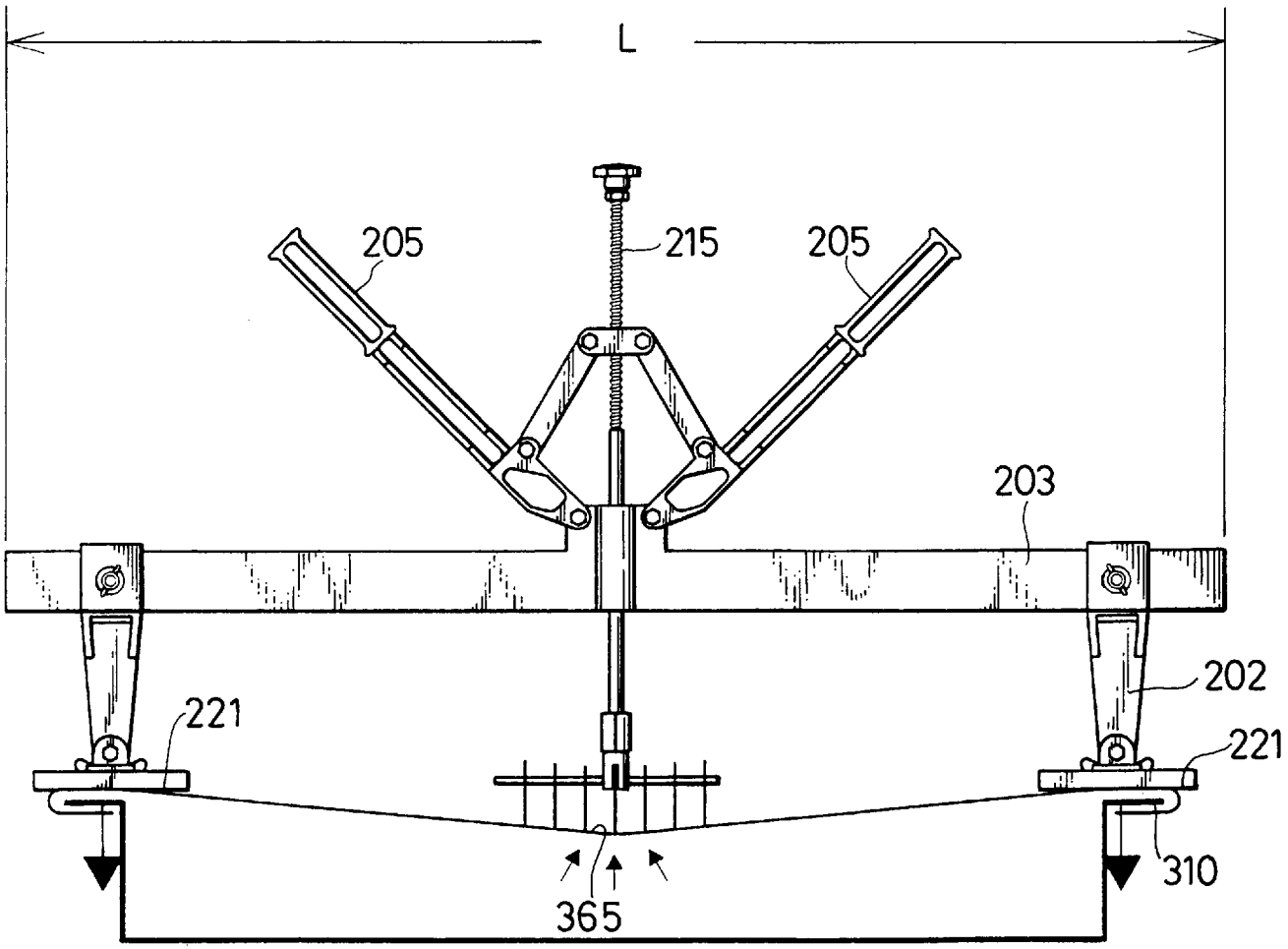
FIG. 19 PRIOR ART
FIG. 19 is a front elevation view showing still another manner of operation of a conventional sheet metal drawing equipment.
Figure 20:
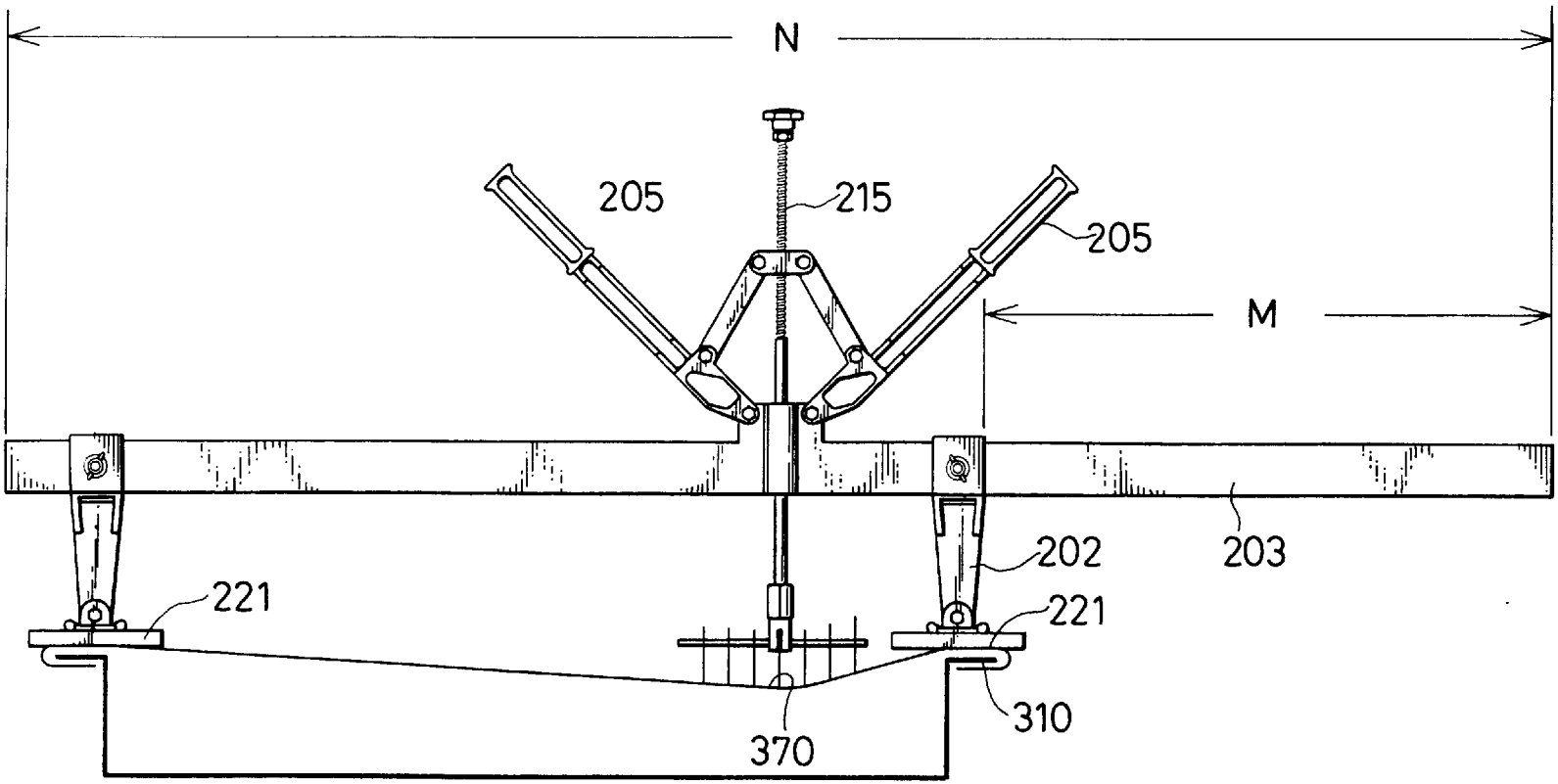
FIG. 20 PRIOR ART
FIG. 20 is a front elevation view showing yet another manner of operation of a conventional sheet metal drawing equipment.

Referring now to FIG. 16, another embodiment of a sheet metal drawing equipment according to the present invention is illustrated. A sheet metal drawing equipment of the illustrated embodiment is constructed in such a manner that legs 202 each include a leg body 222 and a single leg member 224 pivotally supported on the leg body 222 and magnets 86 are substituted for the suction discs 81 in the embodiment described above. The remaining part of the illustrated embodiment may be constructed in substantially the same manner as the above-described embodiment.

As can be seen from the foregoing, the sheet metal drawing equipment of the present invention is constructed so as to provide the side rail means with strength or rigidity of a level sufficient to substantially prevent deformation of the side rail means, to thereby ensure that the sheet metal drawing equipment exhibits satisfactory durability.

Also, in the sheet metal drawing equipment of the present invention, the operation arms and central shaft are moved to any desired position in the longitudinal direction of the side rail means as desired, so that drawing of the sheet metal in various manners and stabilization of a gravity of the equipment may be accomplished while keeping a length of the side rail means minimized, resulting in sheet metal working being safely and readily carried out.

Arrangement of the drawing depth determination means in the present invention permits drawing of the sheet metal to the reference plane to be previously set, so that sheet metal working may be efficiently practiced.

Moreover, arrangement of the suspension support means in the present invention permits both setting of the equipment with respect to a surface of the sheet metal and sheet metal working to be efficiently accomplished.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A sheet metal drawing equipment comprising:

a pair of legs each provided with at least one surface contact section which is adapted to be abuttedly contacted with a surface of a sheet metal;

a side rail means for slidably supporting said legs thereon;

a slide frame means slidably supported on said side rail means and formed at a central portion thereof with a through-hole;

a pair of operation arms each pivotally supported at one end thereof on said slide frame means;

a central shaft arranged so as to extend in a direction perpendicular to a longitudinal direction of said side rail means, inserted via said through-hole of said slide frame means and moved by operation of said operation arms;

connection arms each arranged in correspondence to each of said operation arms and pivotally connected at one end thereof to a corresponding one of said operation arms and at the other end thereof to said central shaft; and drawing depth determination means for determining a depth in which the sheet metal is drawn to a reference plane acting as a standard of drawing of the sheet metal;

said drawing depth determination means being arranged on said slide frame means.

2. A sheet metal drawing equipment as defined in claim 1, wherein said slide frame means, operation arms and central shaft are arranged so as to be integrally slidable in the longitudinal direction of said side rail means.

3. A sheet metal drawing equipment as defined in claim 1, wherein said side rail means includes two rails arranged in a manner to be parallel to each other;

said central shaft being inserted between said rails while being guided by said slide frame means.

4. A sheet metal drawing equipment as defined in claim 3, wherein said rails of said side rail means are fixedly connected to each other with spacers being arranged at both ends of said rails while being interposed therebetween so that a gap (D) is defined therebetween.

5. A sheet metal drawing equipment as defined in claim 4, wherein said slide frame means is formed therein with a passage through which said rails of said side rail means are inserted; and said slide frame means is formed on a central portion of inner upper and lower surfaces thereof defining said passage with elongated projections in a manner to extend in the longitudinal direction of said side rail means inserted through said slide frame means;

said elongated projections cooperating with said spacers to keep said gap between said rails throughout said side rail means.

6. A sheet metal drawing equipment as defined in claim 5, wherein said side rail means and slide frame means are fixed to each other by threadedly inserting a thumb screw into a body of said slide frame means and then advancing it into said passage to securely abut it against one of said rails while keeping said rails inserted through said passage of said slide frame means.

7. A sheet metal drawing equipment as defined in claim 6, wherein said operation arms each are positioned on an extension of a plane defined by said two rails.

8. A sheet metal drawing equipment as defined in claim 1, wherein said drawing depth determination means are suspended from said slide frame means and comprise a measuring bar, a spring fixed at one end thereof on a distal end of said measuring bar, and a contact arranged on a side of a free end of said spring so as to be contacted with a surface of the sheet metal to be drawn.

9. A sheet metal drawing equipment as defined in claim 8, wherein said measuring bar of said drawing depth determination means is mounted on said slide frame means through a presser plate.

10. A sheet metal drawing equipment as defined in claim 1, wherein said legs each are provided with two of said surface contact sections.

11. A sheet metal drawing equipment as defined in claim 1, further comprising a pair of suspension support means for suspendedly supporting a body of the sheet metal drawing equipment.

12. A sheet metal drawing equipment as defined in claim 11, wherein said suspension support means each include a sucking disc and a connection cord tightly connected at one end thereof to said sucking disc and at the other end thereof to each of said legs.

13. A sheet metal drawing equipment as defined in claim 11, wherein said suspension support means each include a magnet and a connection rod tightly connected at one end thereof to said magnet and at the other end thereof to each of said legs.

14. A sheet metal drawing equipment as defined in claim 12, wherein said legs each are provided with one of said surface contact section.

15. A sheet metal drawing equipment comprising:

a pair of legs each provided with at least one surface contact section which is adapted to be abuttedly contacted with a surface of a sheet metal;

a side rail means for slidably supporting said legs thereon;

a slide frame means slidably supported on said side rail means and formed at a central portion thereof with a through-hole;

a pair of operation arms each pivotally supported at one end thereof on said slide frame means;

a central shaft arranged so as to extend in a direction perpendicular to a longitudinal direction of said side rail means, inserted via said through-hole of said slide frame means and moved by operation of said operation arms;

connection arms each arranged in correspondence to each of said operation arms and pivotally connected at one end thereof to a corresponding one of said operation arms and at the other end thereof to said central shaft;

said slide frame means, operations arms and central shaft being arranged so as to integrally slidable in the longitudinal direction of said side rail means; and drawing depth determination means for determining a depth in which the sheet metal is drawn to a reference plane acting as a standard of drawing of the sheet metal:

said drawing depth determination means being arranged on said slide frame means.

16. A sheet metal drawing equipment comprising:

a pair of legs each provided with at least one surface contact section which is adapted to be abuttedly contacted with a surface of a sheet metal;

a side rail means for slidably supporting said legs thereon;

a slide frame means slidably supported on said side rail means and formed at a central portion thereof with a through-hole;

a pair of operation arms each pivotally supported at one end thereof on said slide frame means;

a central shaft arranged so as to extend in a direction perpendicular to a longitudinal direction of said side rail means, inserted via said through-hole of said slide frame means and moved by operation of said operation arms;

connection arms each arranged in correspondence to each of said operation arms and pivotally connected at one end thereof to a corresponding one of said operation arms and at the other end thereof to said central shaft;

a pair of suspension support means for suspendedly supporting a body of the sheet metal drawing equipment; and drawing depth determination means for determining a depth in which the sheet metal is drawn to a reference plane acting as a standard of drawing of the sheet metal;

said drawing depth determination means being arranged on said slide frame means.

17. A sheet metal drawing equipment as defined in claim 15, wherein said drawing depth determination means comprise a measuring bar, a spring fixed at one end thereof on a distal end of said measuring bar, and a contact arranged on a side of a free end of said spring so as to be contacted with a surface of the sheet metal to be drawn.

18. A sheet metal drawing equipment as defined in claim 17, wherein said measuring bar of said drawing depth determination means is mounted on said slide frame means through a presser plate.

19. A sheet metal drawing equipment as defined in claim 16, wherein said drawing depth determination means comprise a measuring bar, a spring fixed at one end thereof on a distal end of said measuring bar, and a contact arranged on a side of a free end of said spring so as to be contacted with a surface of the sheet metal to be drawn.

20. A sheet metal drawing equipment as defined in claim 19, wherein said measuring bar of said drawing depth determination means is mounted on said slide frame means through a presser plate.

* * * * *